US010670050B2

(12) United States Patent
Kim

(10) Patent No.: US 10,670,050 B2
(45) Date of Patent: Jun. 2, 2020

(54) APPARATUS AND METHOD FOR CONTROLLING SPOOL DISPLACEMENT OF CONSTRUCTION MACHINE

(71) Applicant: DOOSAN INFRACORE CO., LTD., Incheon (KR)

(72) Inventor: Ki Yong Kim, Seoul (KR)

(73) Assignee: DOOSAN INFRACORE CO., LTD., Incheon (KR)

( * ) Notice: Subject to any disclaimer, the term of this patent is extended or adjusted under 35 U.S.C. 154(b) by 5 days.

(21) Appl. No.: 14/781,495

(22) PCT Filed: Apr. 1, 2014

(86) PCT No.: PCT/KR2014/002754

§ 371 (c)(1),
(2) Date: Sep. 30, 2015

(87) PCT Pub. No.: WO2014/163362

PCT Pub. Date: Oct. 9, 2014

(65) Prior Publication Data

US 2016/0053778 A1 Feb. 25, 2016

(30) Foreign Application Priority Data

Apr. 3, 2013 (KR) ..... 10-2013-0036127

(51) Int. Cl.
*F02D 29/04* (2006.01)
*F15B 11/08* (2006.01)
(Continued)

(52) U.S. Cl.
CPC ..... *F15B 11/08* (2013.01); *E02F 9/2217* (2013.01); *E02F 9/2235* (2013.01);
(Continued)

(58) Field of Classification Search
CPC ..... E02F 9/2235; E02F 9/2285; E02F 9/2267; E02F 9/2217; F15B 11/08; F15B 13/0416;
(Continued)

(56) References Cited

U.S. PATENT DOCUMENTS 6,286,412 B1 9/2001 Manring et al.
6,662,705 B2 * 12/2003 Huang ..... F15B 11/006 60/459
(Continued)

FOREIGN PATENT DOCUMENTS

CN 1786486 A 6/2006
CN 102803687 A 11/2012
(Continued)

OTHER PUBLICATIONS

European Search Report for corresponding European Patent Application No. 14780000.7 dated Nov. 2, 2016, citing the above reference(s).
(Continued)

*Primary Examiner* — Abiy Teka
(74) *Attorney, Agent, or Firm* — Hauptman Ham, LLP

(57) ABSTRACT

Provided are an apparatus and a method for controlling spool displacement of a construction machine, which are capable of improving regeneration efficiency of the construction machine, and improving a fuel efficiency characteristic of the construction machine by reducing pressure loss in the operating mode by adjusting the quantity of spool displacement in a regeneration mode when a current pressure of a main pump is less than a predetermined operating pressure, and determining whether the construction machine is in an operating mode or the regeneration mode in real time according to an operating angle of a joystick and the current pressure of the main pump when the current pressure of the
(Continued)

main pump is greater than or equal to the predetermined operating pressure to variably change the quantity of spool displacement in the operating mode.

6 Claims, 4 Drawing Sheets

(51) Int. Cl.
*E02F 9/22* (2006.01)
*F15B 11/024* (2006.01)

(52) U.S. Cl.
CPC ..... *E02F 9/2267* (2013.01); *E02F 9/2285* (2013.01); *E02F 9/2292* (2013.01); *E02F 9/2296* (2013.01); *F02D 29/04* (2013.01); *F15B 11/024* (2013.01); *F15B 2011/0246* (2013.01); *F15B 2211/3133* (2013.01); *F15B 2211/329* (2013.01); *F15B 2211/635* (2013.01); *F15B 2211/6346* (2013.01); *F15B 2211/665* (2013.01); *F15B 2211/6658* (2013.01); *F15B 2211/7053* (2013.01); *F15B 2211/761* (2013.01)

(58) Field of Classification Search
CPC ..... F15B 11/024; F15B 21/14; F15B 2011/0243; F15B 2011/0246
See application file for complete search history.

(56) References Cited

U.S. PATENT DOCUMENTS

| | | | | |
|---|---|---|---|---|
| 7,252,030 | B2 * | 8/2007 | Kim | F15B 11/0423 91/365 |
| 2008/0072749 | A1 | 3/2008 | Pfaff et al. | |
| 2012/0089288 | A1 * | 4/2012 | Kawashima | B60K 6/485 701/22 |
| 2013/0263583 | A1 | 10/2013 | Shin | |

FOREIGN PATENT DOCUMENTS

| | | | |
|---|---|---|---|
| DE | 19548943 | A1 | 7/1997 |
| EP | 1669613 | A1 | 6/2006 |
| JP | 2000009244 | A | 1/2000 |
| JP | 2007009675 | A | 1/2007 |
| KR | 100956999 | B1 | 5/2010 |
| KR | 100974273 | B1 | 8/2010 |
| KR | 1020120073046 | A | 7/2012 |
| WO | 2009/084853 | A2 | 7/2009 |
| WO | 2012/091192 | A1 | 7/2012 |

OTHER PUBLICATIONS

International Search Report for PCT/KR2014/002754 dated Jul. 7, 0214, citing the above reference(s).
hinese Office Action dated Apr. 19, 2017 corresponding to Chinese Application No. CN 201480019145.4, citing the above reference(s).

* cited by examiner

APPARATUS AND METHOD FOR CONTROLLING SPOOL DISPLACEMENT OF CONSTRUCTION MACHINE

TECHNICAL FIELD

The present disclosure relates to an apparatus and a method for controlling spool displacement of a construction machine, and more particularly, to an apparatus and a method for controlling spool displacement of a construction machine, which are capable of improving a regeneration efficiency characteristic of the construction machine, and improving fuel efficiency of the construction machine by reducing pressure loss in the operating mode by determining the quantity of operating a joystick by a driver and comparing a current pressure of a main pump with a predetermined operating pressure, adjusting the quantity of spool displacement in a regeneration mode when the current pressure of the main pump is less than the predetermined operating pressure, and variably adjusting the quantity of spool displacement in an operating mode when the current pressure of the main pump is greater than or equal to the predetermined operating pressure.

BACKGROUND ART

In general, a hydraulic system for a construction machine includes an engine generating power, a main pump driven by receiving the power of the engine to discharge working oil, a plurality of actuators performing an operation, an operating unit operated so as to operate an actuator of a desired operating device, and a main control valve distributing working oil required by an operation of the operating unit to a corresponding actuator.

In general, the actuator includes a boom, an arm, a bucket, a swing, a travel device, and the like.

The operating unit forms a request command according to displacement of an operation by an operator, and a flow rate of working oil discharged from a hydraulic pump is controlled by the request command. The operating unit includes, for example, a joystick and a pedal.

FIG. 1 is a schematic diagram for describing efficiency of a construction machine in an operating mode and a regeneration mode in the construction machine in the related art, and FIG. 2 is a graph for a design of an orifice area in consideration of efficiency of the operating mode and the regeneration mode in the construction machine in the related art.

As illustrated in FIGS. 1 and 2, a signal is transmitted from a pilot gear pump 5 to a main control valve 3 according to an operation of a joystick 4 by a driver, and working oil discharged from a main pump 2 is supplied to cylinders 7 of various actuators (not illustrated in the drawings) via a main control valve 3 and an orifice 6 according to the signal, so that an operation, such as an excavation operation, requiring large power is performed in an operating mode.

However, when an operation, such as boom down, arm crowd, and buck crowd operations, is performed by a self-load in the construction machine in the related art, efficiency of the construction machine has been improved by using working oil again by using power generated by the self-load for a regeneration function as represented by reference numeral c of FIG. 1.

As illustrated in FIG. 2, when an operation receiving a large load is performed in the operating mode (a dotted line), it is possible to improve fuel efficiency by reducing pressure loss by increasing an area of the orifice 6 and thus decreasing back pressure.

However, as illustrated in FIG. 2, in order to increase regeneration efficiency in the regeneration mode (an alternated long and short dash line), an area of the orifice 6 needs to be small, and thus regeneration efficiency may be improved by increasing a flow rate of working oil flowing into an upper end of the cylinder 7.

As illustrated in FIG. 2, in the related art, an area of the orifice 6 is designed in a compromised state (solid line) in consideration of the quantity of load generated in the operating mode and efficiency in the regeneration mode, so that there is a problem in that regeneration efficiency deteriorates in the regeneration mode, and pressure is lost in the operating mode and thus fuel efficiency deteriorates.

DISCLOSURE

Technical Problem

The present disclosure is conceived so as to solve the problems in the related art, and an object of the present disclosure is to provide an apparatus for controlling spool displacement of a construction machine, which is capable of improving regeneration efficiency of the construction machine, and improving a fuel efficiency characteristic of the construction machine by reducing pressure loss in the operating mode, by adjusting the quantity of spool displacement in a regeneration mode when a current pressure of a main pump is less than a predetermined operating pressure, and determining whether the construction machine is in an operating mode or the regeneration mode in real time according to the quantity of operation of a joystick and the current pressure of a main pump and variably changing the quantity of spool displacement in the operating mode when the current pressure of the main pump is greater than or equal to the predetermined operating pressure.

Further, the present disclosure is conceived so as to solve the problems in the related art, and another object of the present disclosure is to provide a method for controlling spool displacement of a construction machine.

Technical Solution

In order to achieve the technical object, an exemplary embodiment of the present disclosure provides an apparatus for controlling displacement of a spool of a construction machine, which includes a main pump driven by an engine, actuators driven by working oil discharged from the main pump, a main control valve configured to control driving of the actuator according to a quantity of displacement of a spool installed therein, a joystick configured to adjust the main control valve, and a pilot gear pump configured to discharge working oil for driving the main control valve, the apparatus including: a control unit configured to generate a signal for the quantity of displacement of the spool according to a quantity of operation of the joystick and a current pressure of the main pump; a spool displacement adjusting unit configured to adjust the quantity of displacement of the spool according to the signal generated by the control unit; and a hydraulic line configured to supply working oil discharged from the pilot gear pump to the spool displacement adjusting unit.

The control unit may include: a joystick operation quantity determining unit configured to determine the quantity of operation of the joystick; a main pump pressure comparing unit configured to compare the current pressure of the main pump with a predetermined operating pressure; and a signal generating unit configured to generate a signal for controlling the spool to have a value smaller than a maximum permissible displacement quantity of the spool when the current pressure of the main pump is less than the predetermined operating pressure as a result of the determination of the main pump pressure comparing unit.

The signal for changing the spool to have a value smaller than the maximum permissible displacement quantity of the spool generated by the signal generating unit of the control unit may have a value of 70% to 90% of the maximum permissible displacement quantity of the spool.

The spool displacement adjusting unit may be an electronic proportional pressure reducing valve (EPPRV).

Another exemplary embodiment of the present disclosure provides a method of controlling spool displacement of a construction machine, the method including: an operation of determining a quantity of operation of a joystick by a driver; an operation of comparing a current pressure of a main pump with a predetermined operating pressure; an operation of generating a signal for determining a quantity of displacement of a spool according to the quantity of operation of the joystick according to a result of the comparison; and an operation of adjusting the quantity of displacement of the spool according to the generated signal.

The method may further include: after the operation of comparing the current pressure of the main pump with the predetermined operating pressure, an operation of generating a signal for changing the spool to have a value smaller than a maximum permissible displacement quantity of the spool when the pressure of the main pump is less than the predetermined operating pressure; and an operation of generating a signal for changing the spool to have a value of the maximum permissible displacement quantity of the spool when the pressure of the main pump is greater than or equal to the predetermined operating pressure.

The signal generated in the operation of generating the signal for changing the spool to have the value smaller than the maximum permissible displacement quantity of the spool may have a value of 70% to 90% of the maximum permissible displacement quantity of the spool.

Effects

The apparatus and method for controlling displacement of the spool of the construction machine according to the present disclosure have the effect in improving regeneration efficiency and operation efficiency according to a state of the construction machine by controlling the quantity of displacement of the spool by determining the quantity of operation of the joystick by a driver and comparing and determining a current pressure state of the main pump.

Further, the apparatus and method for controlling displacement of the spool of the construction machine according to the present disclosure have the effect in improving convenience for a driver by simply controlling the quantity of displacement of the spool in real time according to a current state of the construction machine even without requiring a separate operation performed by a driver.

Figure 1:
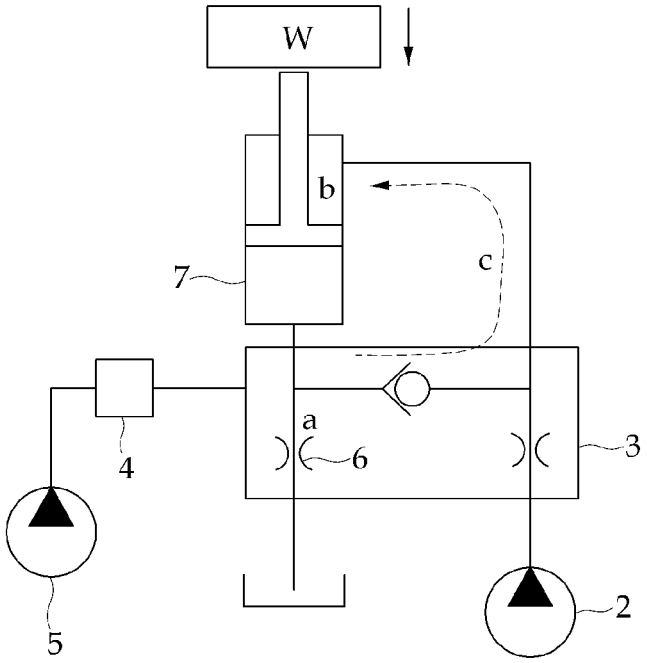
FIG. 1 is a schematic diagram for describing efficiency of a construction machine in an operating mode and a regeneration mode in the construction machine in the related art.

| <Description of Reference Numerals and Signs> | |
|---|---|
| 2: Main pump | 3: Main control valve |
| 4: Joystick | 5: Pilot gear pump |
| 6: Orifice | 7: Cylinder |
| 8: Spool | 10: Control unit |
| 11: Joystick operation quantity determining unit | |
| 12: Main pump pressure comparing unit | |
| 13: Signal generating unit | 20: Spool displacement adjusting unit |
| 30: Hydraulic line | |
| S1: Operation of determining quantity of operation of joystick | |
| S2: Operation of comparing current pressure of main pump with predetermined operating pressure | |
| S2-1: Operation of generating signal for changing spool to have value less than maximum permissible displacement quantity of spool | |
| S2-2: Operation of generating signal for changing spool to have maximum permissible displacement quantity of spool | |
| S3: Operation of generating signal | |
| S4: Operation of adjusting quantity of displacement of spool | |

Hereinafter, an exemplary embodiment of the present disclosure will be described in detail with reference to the accompanying drawings. First of all, in giving reference numerals to elements of each drawing, like reference numerals refer to like elements.

Figure 3:
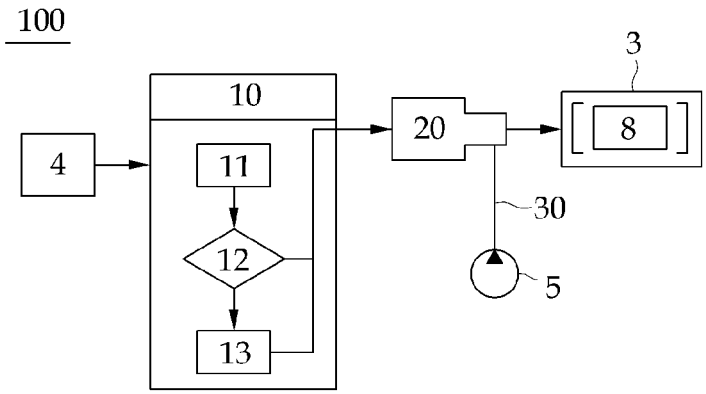
FIG. 3 is a block diagram illustrating an apparatus for controlling spool displacement of a construction machine according to an exemplary embodiment of the present disclosure.
Figure 4:
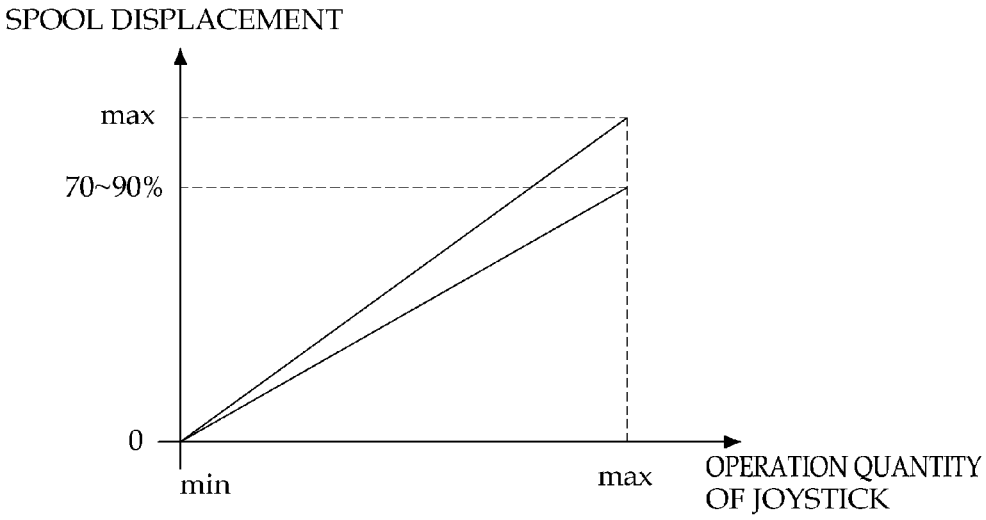
FIG. 4 is a graph illustrating the quantity of change according to the quantity of operation of a joystick and spool displacement.
Figure 5:
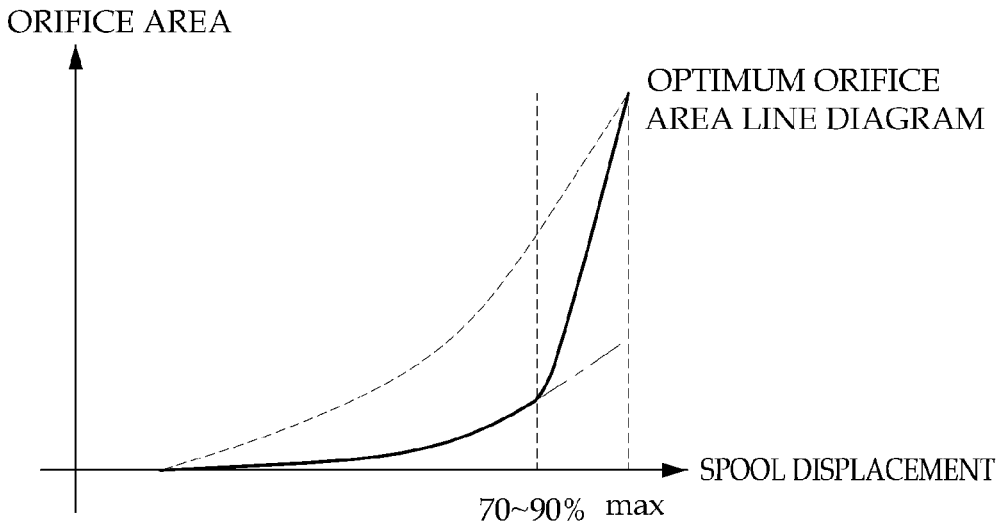
FIG. 5 is a graph illustrating the quantity of spool displacement and a state, in which an orifice area is changed into an optimized state according to the quantity of spool displacement according to the apparatus for controlling spool displacement of the construction machine according to the exemplary embodiment of the present disclosure.
Figure 6:
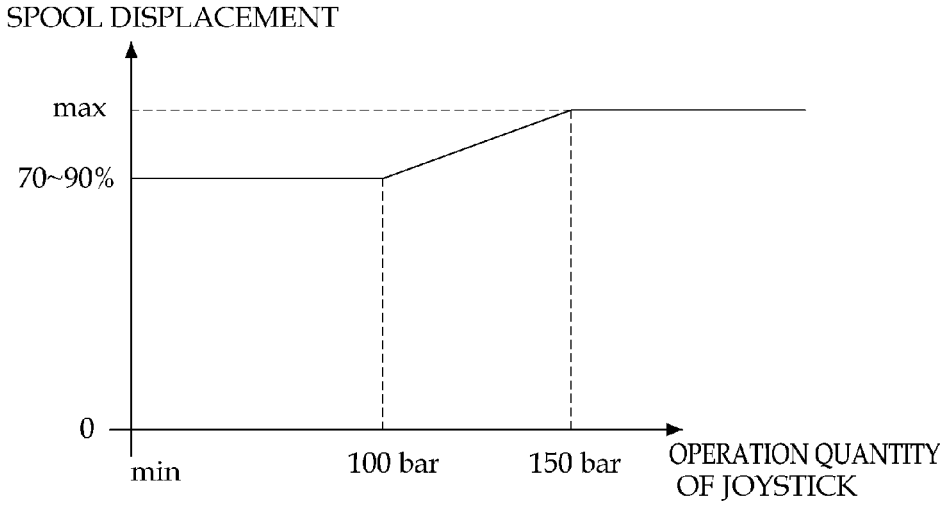
FIG. 6 is a graph illustrating the quantity of operation of a joystick and the quantity of spool displacement when a pressure in an operating mode is between 100 bar to 150 bar according to the exemplary embodiment of the present disclosure.

FIG. 3 is a block diagram illustrating an apparatus for controlling spool displacement of a construction machine according to an exemplary embodiment of the present disclosure. FIG. 4 is a graph illustrating the quantity of change according to an operating angle of a joystick and spool displacement, FIG. 5 is a graph illustrating the quantity of spool displacement and a state, in which an orifice area is changed into an optimized state according to the quantity of spool displacement, according to the apparatus for controlling spool displacement of the construction machine according to the exemplary embodiment of the present disclosure, and FIG. 6 is a graph illustrating the quantity of operation of a joystick and the quantity of spool displacement when a pressure in an operating mode is between 100 bar to 150 bar according to the exemplary embodiment of the present disclosure.

An apparatus 100 for controlling spool displacement of a construction machine according to the present disclosure will be described with reference to FIGS. 3 to 6. The apparatus 100 for controlling spool displacement of the construction machine according to the present disclosure includes a control unit 10, a spool displacement adjusting unit 20, and a hydraulic line 30.

The main pump 2 is driven by an engine, and actuators, such as a boom, an arm, a bucket, a swing, a travel device, are driven by working oil discharged from the main pump 2.

A main control valve (MCV) 3 controls the driving of the actuator according to displacement of a spool 8 installed therein.

That is, displacement of the spool 8 installed in the MCV 3 is adjusted according to the quantity of operation of a joystick 4 by a driver. More particularly, a pilot gear pump 5 discharges working oil in order to drive the spool 8 installed inside the MCV 3 according to a signal of the joystick 4.

The control unit 10 generates a signal for the quantity of displacement of the spool 8 according to the quantity of operation of the joystick 4 and a current pressure of the main pump 2.

The spool displacement adjusting unit 20 adjusts the quantity of displacement of the spool 8 according to a signal generated by the control unit 10.

The hydraulic line 30 is connected to the spool displacement adjusting unit 20, and supplies working oil discharged from the pilot gear pump 5 to the spool displacement adjusting unit 20.

According to another exemplary embodiment of the present disclosure, the spool displacement adjusting unit 20 is formed with an electronic proportional pressure reducing valve (EPPRV).

Accordingly, the spool displacement adjusting unit 20 formed with the EPPRV variably adjusts the quantity of displacement of the spool 8 by transmitting pressure of the working oil discharged from the pilot gear pump 5 with the same pressure to the spool with changed pressure in real time according to a signal generated, by the control unit, by determining and comparing the quantity of operation of the joystick 4 and the current pressure of the main pump 2.

As illustrated in FIG. 3, a control unit 10 of an apparatus 100 for controlling spool displacement of a construction machine according to another exemplary embodiment of the present disclosure includes a joystick operation quantity determining unit 11, a main pump pressure comparing unit 12, and a signal generating unit 13.

The joystick operation quantity determining unit 11 determines the quantity of operation of the joystick 4, that is, an operating angle of the joystick 4, operated by the driver.

The main pump pressure comparing unit 12 compares a current pressure of the main pump 2 with a predetermined operating pressure.

As illustrated in FIG. 6, according to the exemplary embodiment of the present disclosure, the predetermined operating pressure is formed in a predetermined numerical range having a lower limit value and an upper limit value. In one embodiment, the predetermined operating pressure can be set to a numerical range having an upper limit value of 150 bar from a lower limit value of 100 bar.

In one embodiment, in a case where the predetermined operating pressure is a numerical range of 100 bar to 150 bar, when the current pressure of the main pump is equal to or greater than the upper limit value of 150 bar, the main pump pressure comparing unit 12 determines a mode of the apparatus 100 as an operating mode, and when the current pressure of the main pump is less than the lower limit value of 100 bar the main pump pressure comparing unit 12 recognizes a mode of the apparatus 100 as a regeneration mode.

However, the predetermined operating pressure may be variously changed according to the kind and a size of the construction machine, and a setting mode of the construction machine.

The signal generating unit 13 generates a signal for changing the spool to have a value smaller than a maximum permissible displacement quantity of the spool 8 when the current pressure of the main pump 2 is less than the predetermined operating pressure according to a result of the determination of the main pump pressure comparing unit 12. The present disclosure is not essentially limited thereto, and the signal for changing the spool 8 to have the value smaller than the maximum permissible displacement quantity of the spool 8 generated by the signal generating unit 13 is formed with a value of 70% to 90% of the maximum permissible displacement quantity of the spool 8. Further, when the current pressure of the main pump 2 is greater than or equal to the predetermined operating pressure, the signal generating unit 13 generates a signal formed with a value of the maximum permissible displacement quantity of the spool 8.

That is, as illustrated in FIG. 4, when the current pressure of the main pump 2 is less than the predetermined operating pressure, the spool 8 is changed to have only 70% to 90% of the maximum permissible displacement quantity of the spool 8, and when the current pressure of the main pump 2 is greater than or equal to the predetermined operating pressure, the spool 8 is changed to have the maximum permissible displacement quantity of the spool 8.

When the maximum permissible displacement quantity of the spool 8 is less than 70%, the quantity of displacement of the spool 8 does not much influence regeneration efficiency, and when the maximum permissible displacement quantity of the spool 8 is equal to or greater than 90%, the problem generated in the construction machine in the related art may be incurred again in the regeneration mode, so that it is preferable to design the spool so that the spool is changed only to have a value of 70% to 90% of the maximum permissible displacement quantity of the spool 8 when the current pressure of the main pump 2 is less than the predetermined operating pressure.

Figure 2:
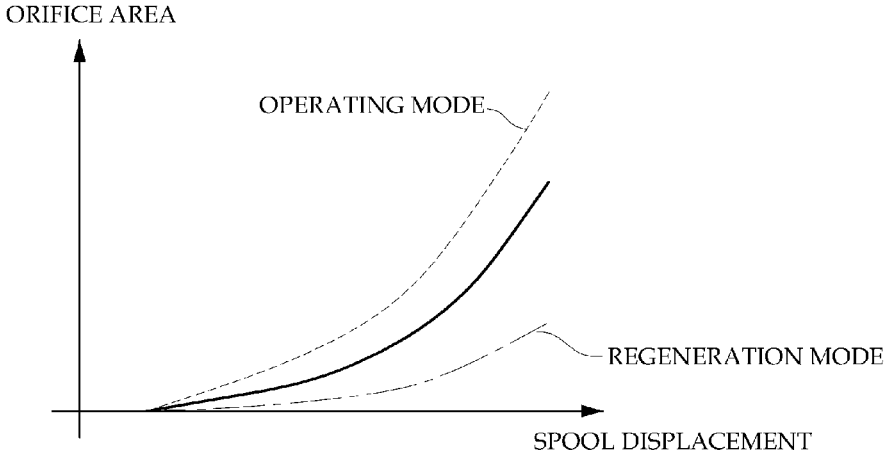
FIG. 2 is a graph for a design of an orifice area in consideration of efficiency of the operating mode and the regeneration mode in the construction machine in the related art.

As illustrated in FIG. 5, the quantity of operation of the joystick, and the current pressure state and the predetermined operating pressure of the construction machine are compared in real time, and the quantity of displacement of the spool 8 is variably controlled according to a value of the comparison, so that unlike the graph of FIG. 2 in the related art, an area line diagram of the orifice is changed according to an optimum area line diagram of the orifice.

Accordingly, regeneration efficiency of the construction machine may be increased, and operating efficiency may be improved by reducing pressure loss.

Further, the quantity of spool displacement is automatically changed into an optimum state without requiring a separate operation performed by the driver according to an operating mode state of the construction machine changed in real time, and thus an orifice area is changed into an optimum state, thereby improving convenience.

Figure 7:
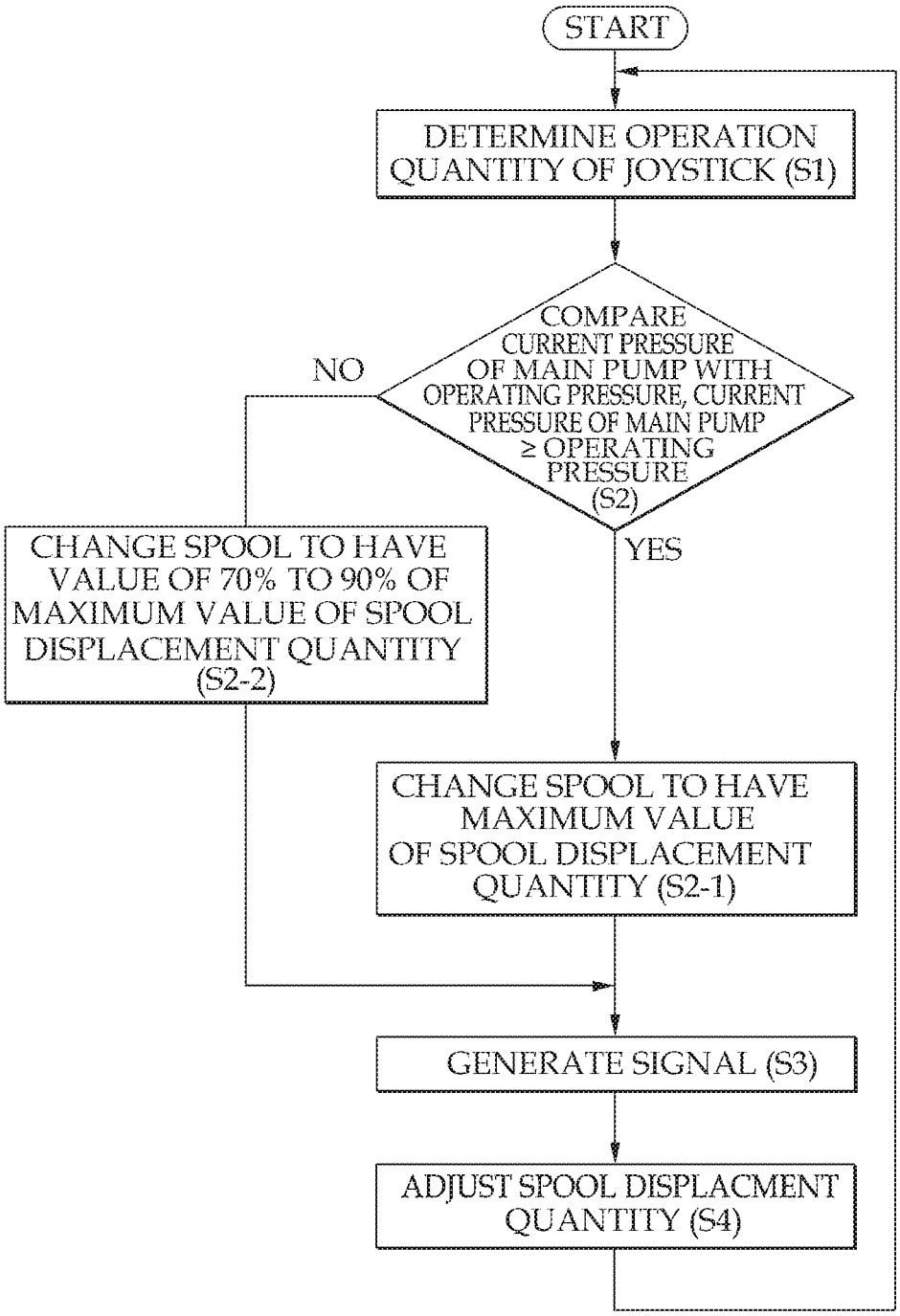
FIG. 7 is a flowchart of a method for controlling spool displacement of a construction machine according to an exemplary embodiment of the present disclosure.

FIG. 7 is a flowchart of a method for controlling spool displacement of a construction machine according to an exemplary embodiment of the present disclosure.

A method for controlling spool displacement of a construction machine according to an exemplary embodiment of the present disclosure will be described with reference to FIG. 7. The method for controlling spool displacement of the construction machine according to the present disclosure includes operation S1 of determining a joystick operation quantity, operation S2 of comparing a current pressure of the main pump with a predetermined operating pressure, operation S3 of generating a signal, and operation S4 of adjusting a spool displacement quantity.

In operation S1 of determining a joystick operation quantity, the quantity of operation of the joystick 4, that is, an operating angle of the joystick 4, operated by a driver is determined. In operation S2 of comparing a current pressure of the main pump with a predetermined operating pressure, a current pressure of the main pump is compared with a predetermined operating pressure. As described above, the predetermined operating pressure may be variously changed and set according to the kind and a size of the construction machine, and a setting mode of the construction machine.

A signal for determining the quantity of displacement of the spool 8 is generated according to a result of the determination of the quantity of operation of the joystick, and a result of the comparison between the current pressure of the main pump 8 and the predetermined operating pressure.

The spool displacement adjusting unit 20, more particularly, the EPPRV, adjusts the quantity of displacement of the spool according to the signal generated after operation S3 of generating the signal.

As illustrated in FIG. 7, according to another exemplary embodiment of the present disclosure, the method further includes operation S2-2 of generating a signal for changing the spool 8 to have a value smaller than a maximum permissible displacement quantity of the spool 8 when the pressure of the main pump 2 is less than the predetermined operating pressure, and operation S2-1 of generating a signal for changing the spool 8 to have a value of the maximum permissible displacement quantity of the spool 8 when the pressure of the main pump 2 is greater than or equal to the predetermined operating pressure, after operation S2 of comparing the current pressure of the main pump 2 with the predetermined operating pressure.

In this case, the signal generated in operation S2-2 of generating the signal for changing the spool 8 to have the value smaller than the maximum permissible displacement quantity of the spool 8 is formed with a value of 70% to 90% of the maximum permissible displacement quantity of the spool 8.

That is, it is possible to improve regeneration efficiency during the operation in the regeneration mode, and decreasing energy consumption by reducing pressure loss during the operation in the operating mode by determining the operating angle of the joystick of the driver and comparing the current pressure of the main pump 2 with the predetermined operating pressure, and controlling the quantity of displacement of the spool 8 according to the values of the determination and the comparison without requiring a separate operation performed by the driver.

The present disclosure is not limited to a modified embodiment illustrated in the drawing and the aforementioned exemplary embodiments, and may be expanded to another exemplary embodiment belonging to a scope of the accompanying claims.

INDUSTRIAL APPLICABILITY

The present disclosure relates to an apparatus and a method for controlling spool displacement of a construction machine, and more particularly, to an apparatus and a method for controlling spool displacement of a construction machine, which are capable of improving regeneration efficiency of the construction machine, and improving a fuel efficiency characteristic of the construction machine by reducing pressure loss in the operating mode by determining an operating angle of a joystick by a driver and comparing a current pressure of a main pump with a predetermined operating pressure, adjusting the quantity of spool displacement in a regeneration mode when the current pressure of the main pump is less than the predetermined operating pressure, and variably adjusting the quantity of spool displacement in an operating mode when the current pressure of the main pump is greater than or equal to the predetermined operating pressure.

The invention claimed is:

1. An apparatus for controlling displacement of a spool of a construction machine, which comprises a main pump driven by an engine, actuator driven by working oil discharged from the main pump, a main control valve configured to control driving of the actuator according to a quantity of displacement of a spool installed therein, a joystick configured to adjust the main control valve, and a pilot gear pump configured to discharge working oil for driving the main control valve, the apparatus comprising:

a control unit configured to generate a signal for the quantity of displacement of the spool according to a quantity of operation of the joystick and a current pressure of the main pump;

a spool displacement adjusting unit configured to adjust the quantity of displacement of the spool according to the signal generated by the control unit; and a hydraulic line configured to supply working oil discharged from the pilot gear pump to the spool displacement adjusting unit, wherein the control unit includes:

a joystick operation quantity determining unit configured to determine the quantity of operation of the joystick;

a main pump pressure comparing unit configured to compare the current pressure of the main pump with a predetermined operating pressure; and a signal generating unit configured to generate a signal for controlling the spool to have a value of displacement quantity smaller than a maximum permissible displacement quantity of the spool as recognized to be in a regeneration mode when the current pressure of the main pump is less than the predetermined operating pressure as a result of the determination of the main pump pressure comparing unit, and generate a signal for controlling the spool to have a value of the maximum permissible displacement quantity of the spool as determined to be in an operating mode when the pressure of the main pump is greater than or equal to the predetermined operating pressure, wherein the predetermined operating pressure is formed in a predetermined numerical range having a lower limit value and an upper limit value, wherein the spool displacement is adjusted in the regeneration mode when the current pressure of the main pump is less than the lower limit value, wherein the spool displacement is adjusted in the operating mode when the current pressure of the main pump is greater than or equal to the upper limit value, and wherein when the current pressure of the main pump is greater than or equal to the lower limit value and less than the upper limit, the spool displacement is adjusted to increase linearly from the spool displacement adjusted in the regeneration mode to the spool displacement adjusted in the operating mode.

2. The apparatus of claim 1, wherein the signal for changing the spool to have a value smaller than the maximum permissible displacement quantity of the spool generated by the signal generating unit has a value of 70% to 90% of the maximum permissible displacement quantity of the spool.

3. The apparatus of claim 2, wherein the spool displacement adjusting unit is an electronic proportional pressure reducing valve (EPPRV).

4. The apparatus of claim 1, wherein the spool displacement adjusting unit is an electronic proportional pressure reducing valve (EPPRV).

5. A method of controlling spool displacement of a construction machine, the method comprising:

determining a quantity of operation of a joystick by a driver;

comparing a current pressure of a main pump with a predetermined operating pressure;

generating a signal for determining a quantity of displacement of a spool according to the quantity of the operation of the joystick according to a result of the comparison;

adjusting the quantity of displacement of the spool according to the generated signal, wherein, after the comparing the current pressure of the main pump with the predetermined operating pressure, the method is further comprising:

generating a signal for changing the spool to have a value smaller than a maximum permissible displacement quantity of the spool as recognized to be in a regeneration mode when the pressure of the main pump is less than the predetermined operating pressure; and generating a signal for changing the spool to have a value of the maximum permissible displacement quantity of the spool as determined to be in an operating mode when the pressure of the main pump is greater than or equal to the predetermined operating pressure, wherein the predetermined operating pressure is formed in a predetermined numerical range having a lower limit value and an upper limit value, wherein the spool displacement is adjusted in the regeneration mode when the current pressure of the main pump is less than the lower limit value, wherein the spool displacement is adjusted in the operating mode when the current pressure of the main pump is greater than or equal to the upper limit value, and wherein when the current pressure of the main pump is greater than or equal to the lower limit value and less than the upper limit, the spool displacement is adjusted to increase linearly from the spool displacement adjusted in the regeneration mode to the spool displacement adjusted in the operating mode.

6. The method of claim 5, wherein the signal generated in the generating the signal for changing the spool to have the value smaller than the maximum permissible displacement quantity of the spool has a value of 70% to 90% of the maximum permissible displacement quantity of the spool.

* * * * *